US005080344A

United States Patent [19]

Hayashi

[11] Patent Number: 5,080,344

[45] Date of Patent: Jan. 14, 1992

[54] SHEET SUPPLYING DEVICE FOR SHEET SUPPLYING OPERATION

[75] Inventor: Shigeyuki Hayashi, Nagoya, Japan

[73] Assignee: Brother Kogyo Kabushiki Kaisha, Japan

[21] Appl. No.: 591,480

[22] Filed: Oct. 1, 1990

[30] Foreign Application Priority Data

Oct. 31, 1989 [JP] Japan ..... 1-285324

[51] Int. Cl.[5] ..... B65H 3/08

[52] U.S. Cl. ..... 271/107; 271/103; 271/106

[58] Field of Search ..... 271/107, 103, 105, 106, 271/108

[56] References Cited

U.S. PATENT DOCUMENTS 4,494,743 1/1985 Kushmaul ..... 271/107 X
4,518,159 5/1985 Nishibori ..... 271/106 X
4,968,019 11/1990 Tanable ..... 271/107 X
5,005,818 4/1991 Hayashi ..... 271/107

FOREIGN PATENT DOCUMENTS 55-93744 7/1980 Japan .

*Primary Examiner*—Richard A. Schacher
*Attorney, Agent, or Firm*—Oliff & Berridge

[57] ABSTRACT

A sheet supplying device is disclosed comprising a drive shaft, a first arm, a second arm, an elevator arm having a suction cup for attracting a sheet, and a roller. When the drive shaft starts to rotate counterclockwise, the first arm rotates counterclockwise together with the elevator arm until the roller disposed on the elevator arm is in contact with the uppermost sheet. When the roller contacts the uppermost sheet, the elevator arm starts to slide along the first arm and rotates clockwise about a point at which the roller contacts the uppermost sheet. The elevator arm and the first arm continue to move until the suction cup contacts the uppermost sheet, and then the suction cup is actuated to attract the uppermost sheet. When the suction cup has attracted the uppermost sheet, the drive shaft starts to rotate clockwise, the first arm rotates clockwise, and then the elevator arm with the suction cup attracting the sheet slides along the first arm. When the sliding of the elevator arm along the first arm is finished, the first arm further rotates clockwise together with the elevator arm, and the sheet moves upwardly and is fed along the feeding direction to the sheet feed path.

21 Claims, 6 Drawing Sheets

SHEET SUPPLYING DEVICE FOR SHEET SUPPLYING OPERATION

BACKGROUND OF THE INVENTION

1. Field of the Invention

The present invention relates to a sheet supplying device for performing a sheet supplying operation, and in particular relates to a sheet supplying device for supplying sheets stacked in a sheet cassette by using suction means for attracting a sheet and feeding the attracted sheet to a sheet feed path of an image forming apparatus such as, for example, a copying machine.

2. Description of the Related Art

In general, image forming apparatus such as copying machines employ a continuous photosensitive recording medium, such as a microcapsule sheet, and developer sheets which are used in combination with the photosensitive recording medium. Developer sheets are stacked in a sheet cassette and usually fed one at a time from the sheet cassette by a semicircular separator roller made of rubber. The separator roller and the developer sheets have coefficients of friction which are different from each other. The separator roller frictionally separates the uppermost developer sheet from the stack of developer sheets, and delivers the separated uppermost developer sheet to a certain predetermined position.

When the uppermost developer sheet is fed out of the sheet cassette, the color developer layer on this uppermost developer sheet rubs against the next developer sheet (the color developer layer faces downward), and the developer material tends to be partially peeled off from the developer sheet. Thus, an image formed on the developer sheet may be damaged where the developer layer has been removed, resulting in poor image quality.

Another sheet supplying device includes suction cups for attracting sheets with a negative pressure and for feeding the attracted sheet to a certain position, as disclosed in Japanese Patent Application Laid-Open No. 55(1980)-93744, for example. Another such suction system is disclosed in U.S. patent application No. 07/472,183 (JAO 26152), the disclosure of which is herein incorporated by reference.

A sheet supplying device has a mechanism for lifting and lowering one or more suction cups to separate and supply sheets from a sheet cassette. The known mechanism includes an elevator arm supporting suction cups and a sheet sensor. When a sheet supplying operation starts, the elevator arm is lowered until the sheet sensor detects the upper surface of the uppermost sheet of the sheet stack in the sheet cassette. When the sheet sensor detects the uppermost sheet, the elevator arm is stopped, and the suction cups are actuated to attract the sheet using a negative pressure. In this mechanism, as the number of sheets remaining in the sheet cassette is reduced, the elevator arm must be lowered a greater distance.

Therefore, so that the elevator arm having the suction cup is capable of moving upwardly and downwardly over a greater distance, the conventional mechanism is relatively complex and requires a large amount of energy for changing the rotation of the driving motor to achieve the requisite vertical movement.

OBJECTS AND SUMMARY OF THE INVENTION

In order to solve the above and other drawbacks of conventional sheet supplying devices, it is an object of the present invention to provide a sheet supplying device having a suction means which can be contacted with the uppermost sheet in a sheet cassette with a simplified mechanism compared with the conventional complex mechanism for moving the elevator arm having the suction cup upwardly and downwardly over a large distance.

It is another object of the present invention to provide a sheet supplying device which can attract sheets without causing a sheet jam.

In order to attain the above and other objects, a sheet supplying device for supplying a sheet stacked in a sheet cassette and for feeding the sheet along a feeding direction wherein the sheet is fed from the sheet cassette which is disposed upstream of a sheet feed path relative to the feeding direction comprises: rotating means for rotating clockwise and counterclockwise directions and positioned at a forward side of the sheet cassette relative to the feeding direction; suction means for attracting an uppermost sheet stacked in the sheet cassette; supporting means for supporting the suction means, and having a first part at a forward side thereof relative to the feeding direction, a second part spaced upstream of said first part relative to the feeding direction, and an edge disposed near said second part for being contacted with the uppermost sheet; a first arm rotatable clockwise and counterclockwise by said rotating means, and having a base portion fixedly mounted to the rotating means for rotation therewith, and a head portion slidably rotatably attached to said first part of the supporting means so that said first part of the supporting means may slide along the first arm; a second arm having a head portion rotatably fixed to said second part of the supporting means, and a base portion pivotally mounted to a support and having a length so that the supporting means and the first arm can be moved by said rotating means to allow the suction means to attract the uppermost sheet when suction is applied therethrough; and rotating controlling means for controlling said rotating means so that said rotating means rotates said first arm counterclockwise so that said edge of the supporting means contacts the uppermost sheet and further continues to rotate said first arm counterclockwise so that the supporting means slides along the first arm to cause the supporting means to rotate clockwise around a point of which the supporting means is pivotally attached to the second arm to cause said suction means to contact the uppermost sheet, said rotating means stopping the counterclockwise rotation upon the contacting of the suction means with the uppermost sheet, said rotating means then rotating said first arm clockwise to feed the attracted uppermost sheet to the sheet feed path.

In the sheet supplying device according to the present invention, when the rotating means starts to rotate counterclockwise, the first arm rotates counterclockwise together with the supporting means. The first arm and the supporting means continue to move together until the edge disposed near the second part of the supporting means contacts the uppermost sheet in the sheet supply cassette. When this edge contacts with the uppermost sheet, the supporting means starts to slide along the first arm and rotates clockwise about the point at which said edge contacts the uppermost sheet, which point acts as a center point of rotation and is also the point where the second arm is pivotally attached to the supporting means. The supporting means and the first arm continue to move until the suction means contacts the uppermost sheet. When the suction means contacts the uppermost sheet, the suction means is supplied with suction and attracts the uppermost sheet.

When the suction means has attracted the uppermost sheet, the rotating means starts to rotate clockwise to cause the first arm to rotate clockwise, and then the supporting means with the suction means attracting the uppermost sheet starts to slide along the first arm.

When the sliding of the supporting means along the first arm is finished, the first arm further rotates clockwise together with the supporting means, and said sheet moves upwardly and then is fed along the feeding direction to the sheet feed path.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Figure 1:
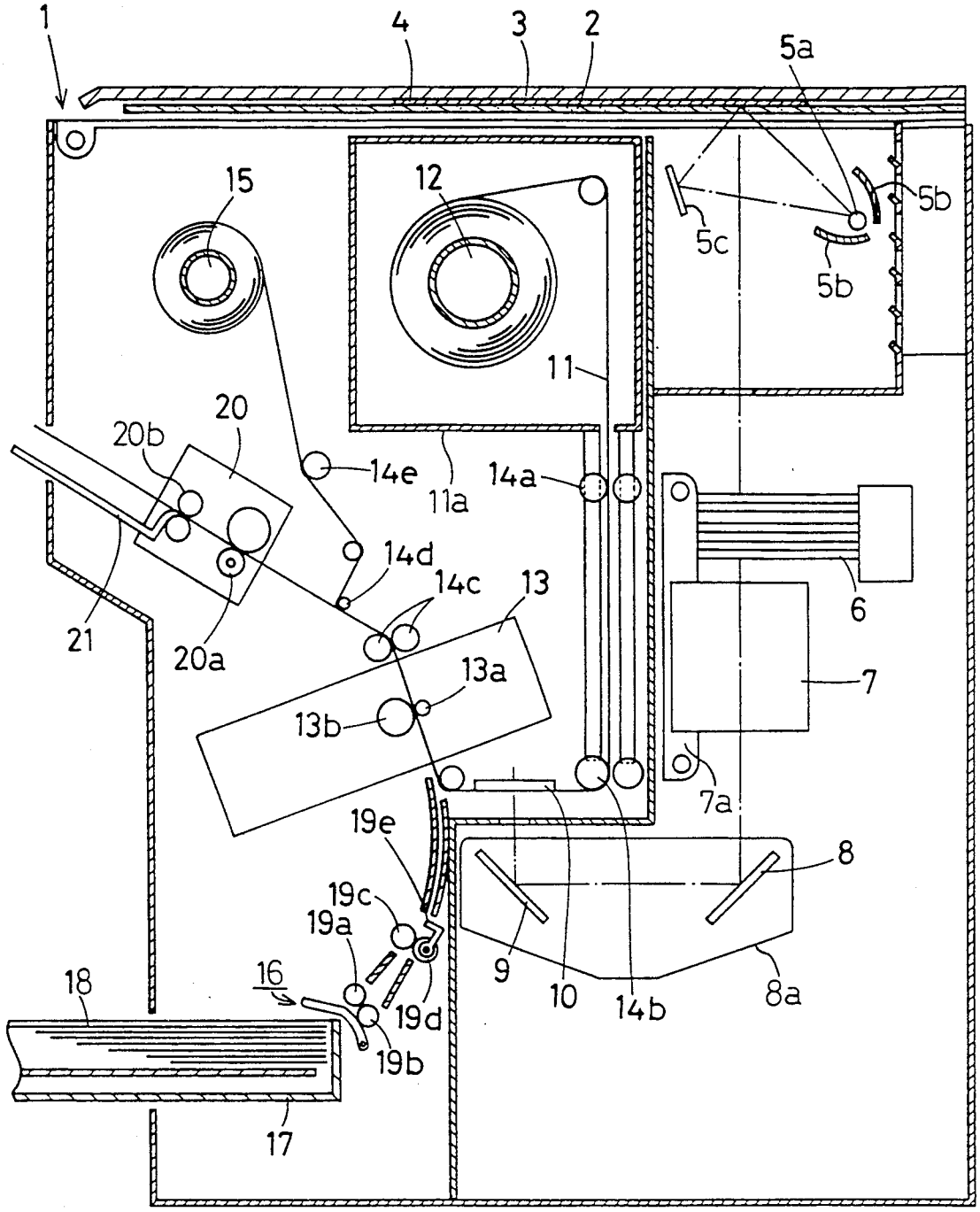
FIG. 1 is a schematic front sectional view showing a copying machine incorporating the sheet supplying device according to the present invention.

Hereafter, one embodiment of the present invention will be described referring to the drawings. This embodiment applies the present invention to a photosensitive pressure-sensitive copying machine capable of copying and producing full-color images.

As shown in FIG. 1, the illustrated copying machine, generally indicated at 1, includes an upper panel assembly having an original support stand glass 2 which is movable back and forth and an original support stand glass cover 3 that can be placed over the original support stand glass 2. An original 4 to be copied is placed on the original support stand glass 2 which is formed of light transmissible material. The copying machine 1 also includes a light source placed in an upper right-hand portion thereof below the original support stand glass 2 which comprises a halogen lamp 5*a* extending in a direction normal to the direction in which the original support stand glass 2 is movable back and forth, and a semicylindrical reflecting mirror 5*b* disposed in surrounding relation to the halogen lamp 5*a*. The light source emits a linear-line of light toward the lower surface of the original support stand glass 2.

When the original support stand glass 2 moves, the light emitted from the halogen lamp 5*a* sequentially irradiates the entire surface of the original support stand glass 2 from the left-hand to the right-hand end thereof (as viewed in FIG. 1). The light from the light source 5 passes through the transparent original support stand glass 2, and is then reflected by the original 4 placed on the original support stand glass 2. The original support stand glass cover 3 covers the entire upper surface of the original support stand glass 2 so that the light applied to the original support stand 2 will not leak out from those areas of the original support stand glass 2 which are not covered by the original. A reflector 5*c* is positioned on the lefthand side of the light source for applying light emitted from the halogen lamp 5*a* to the original in a highly efficient manner. The reflector 5*b* reflects emitted light which is not initially directed toward the original support stand glass 2.

The light reflected from the original on the original support stand glass 2 is directed downwardly and passes through a filter 6 and a lens 7. The filter 6 serves to pass desired wavelengths of light dependent on the sensitivity of a microcapsule sheet 11 for adjusting the colors of a copied image. The lens 7 is mounted on a lens attachment 7*a* which is slightly adjustable with respect to the path of the light through the filter 6 and the lens 7.

The light converged by the lens 7 is directed 180 degrees by two reflecting mirrors 8, 9 and then focused on the microcapsule sheet 11 held closely against the lower surface of an exposure table 10. The reflecting mirrors 8, 9 are mounted on a mirror attachment 8*a* which is slightly positionally adjustable to vary the length of the light path for focusing.

The microcapsule sheet 11 is of a continuously elongated length and is wound around a cartridge reel 12. The microcapsule web sheet 11 is placed in a removable cartridge 11*a* positioned below the original support stand glass 2. A leading end portion of the microcapsule sheet 11 is provided with a leader consisting of a suitable sheet fixed to the leading edge of the microcapsule containing portion thereof and extends through many rollers and a pressure developing unit 13 toward a take-up reel 15.

As shown in FIG. 1, the microcapsule sheet 11 drawn out of the cartridge 11*a* from the lower end is fed and guided by a feed roller 14*a* and a guide roller 14*b*, and extends beneath the exposure table 10 into the pressure developing unit 13. The microcapsule sheet 11 which has passed through the pressure developing unit 13 is fed by a pair of feed rollers 14*c*, travels past a separator roller 14*d* and an adjustment roller 14*e*, and is then wound around the take-up reel 15. The microcapsule sheet 11 discharged from the cartridge 11*a* is prevented from being prematurely exposed by a light-shielding cover before the microcapsule sheet 11 reaches the exposure table 10.

The speed at which the microcapsule sheet 11 is fed is controlled so as to be held at a constant level, and remains the same speed at which the original support stand glass 2 is moved. Therefore, a latent image can be formed successively line by line on the microcapsule sheet 11 when it moves past the exposure table 10.

A developer sheet cassette 17 storing a stack of developer sheets 18 is disposed below the pressure developing unit 13. The developer sheets 18 are taken out of the cassette 17 one at a time by a sheet feed mechanism 16 which attracts each developer sheet 18 with suction. Each developer sheet 18 which is taken from the cassette 17 is further conveyed by a feed roller 19*a* and a pinch roller 19*b* along a sheet feed path. After the leading end of the developer sheet 18 is aligned by rollers 19*c*, 19*d* and a resist gate 19*e*, the developer sheet 18 is fed into an inlet slot of the pressure developing unit 13.

The microcapsule sheet 11 and the developer sheet 18 are closely held against each other when they are introduced into the pressure developing unit 13. The pressure developing unit 13 includes a small diameter roller 13*a* and a backup roller 13*b*. The microcapsule sheet 11 and developer sheet 18 are sandwiched and pressed together between the small diameter roller 13*a* and the backup roller 13*b*. At this time, a microcapsule layer on the microcapsule sheet 11 with the latent image formed thereon and a color developer layer on the developer sheet 18 are held against each other. Those microcapsules in the microcapsule layer which are not exposed are ruptured under pressure and a developed image is transferred onto the developer sheet 18.

The microcapsule sheet 11 and the developer sheet 18 which have left the pressure developing unit 13 are fed by the rollers 14*c*. Then, the microcapsule sheet 11 is separated from the developer sheet 18 by the separator portion 14*d*. The microcapsule sheet 11 is directed upwardly, whereas the developer sheet 18 travels straight ahead into a thermal fixing unit 20. The thermal fixing unit 20 includes a heater roller 20*a* and feed roller 20*b*. After color development on the developer sheet 18 is promoted and the color image is fixed by the heat fixing unit 20, the developer sheet 18 is discharged into a tray 21 with the developed image facing up. The separated microcapsule sheet 11 travels past the adjustment roller 14*e* and is wound around the take-up reel 15.

Figure 7:
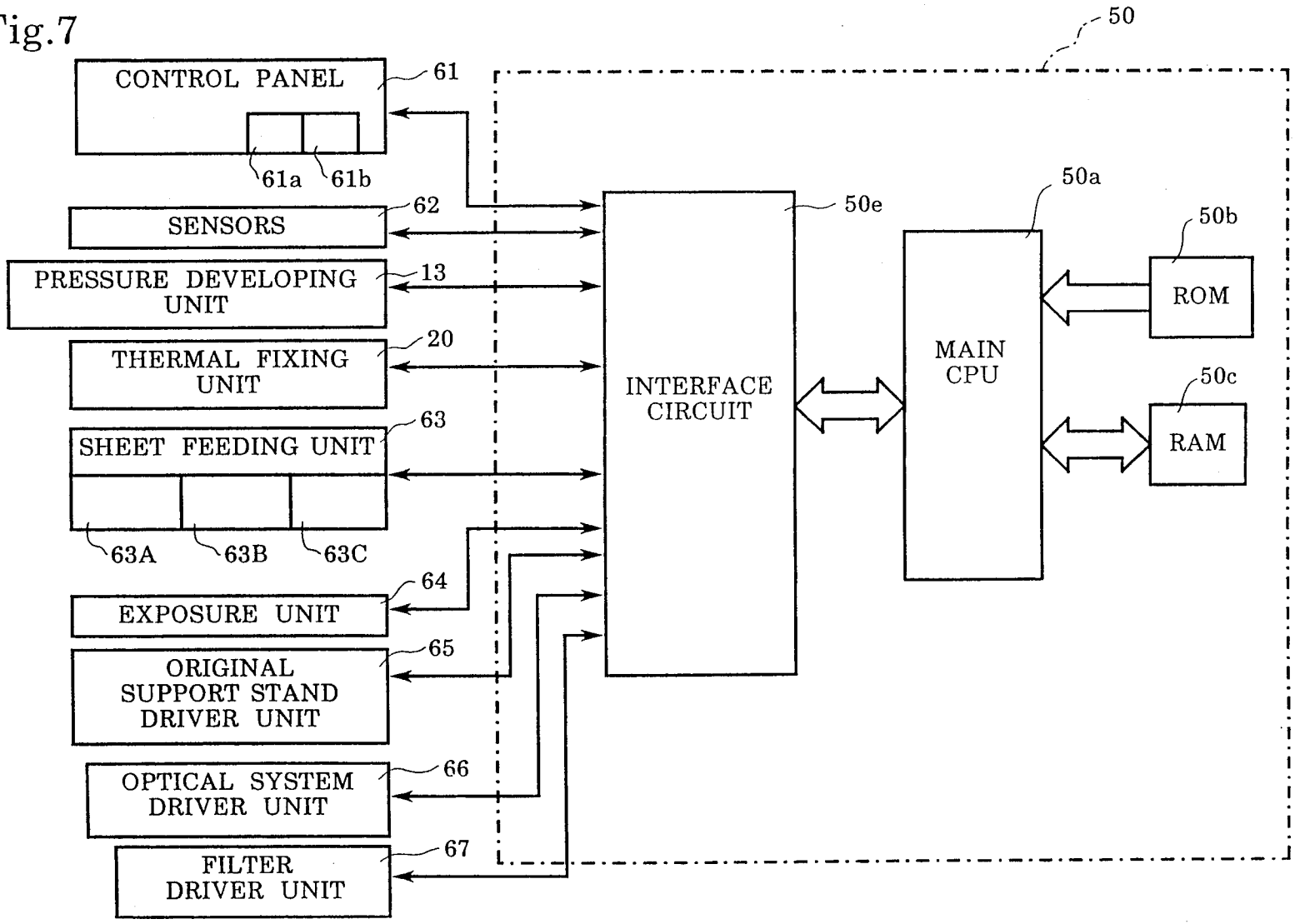
FIG. 7 is a block diagram showing a controller which includes an electrical control circuit.

There will next be described an arrangement of the controller 50, in the instant apparatus 1, by reference to the block diagram of FIG. 7. The controller 50 includes an interface circuit 50*e*, and a main CPU (central processing unit) 50*a*, to which are connected through the interface circuit 50*e*, a control panel 61, sensors 62, the pressure developing unit 13, the thermal fixing unit 20, a sheet feeding unit 63, an exposure unit 64, an original support stand driver unit 65, an optical system driver unit 66 and a filter driver unit 67.

Control panel 61 includes a start key 61*a*, and other input keys 61*b*. Sensors 62 are disposed in the present apparatus to transmit signals to CPU 50*a* to aid in the control of this apparatus. A sheet feeding unit 63 includes a developer sheet feeding portion 63A which controls the feeding of a developer sheet 18, a microcapsule sheet feeding portion 63B which controls the feeding of a microcapsule sheet 11, and a separator roller driving portion 63C. Exposure unit 64 controls halogen lamp 5*a* (i.e., turns lamp 5*a* on and off). Original support stand driver unit 65 controls an original support stand glass 2 to move back and forth. Optical system driver unit 66 controls lens 7 and mirrors 8,9 so that they are located in suitable positions. Filter driver unit 67 controls a filter 6 so that it is located in a suitable position.

The CPU 50*a* is further connected to a ROM (read-only memory) 50*b* and a RAM (random-access memory) 50*c*. The RAM 50*c* acts as a work area for performing various types of processing and stores data temporarily. ROM 50*b* stores various types of processing programs and stores initial data. The CPU 50*a* operates to control the present copying apparatus 1, according to one or more control programs stored in the ROM 50*b*, while utilizing the temporary data storage function of the RAM 50*c*.

Figure 2:
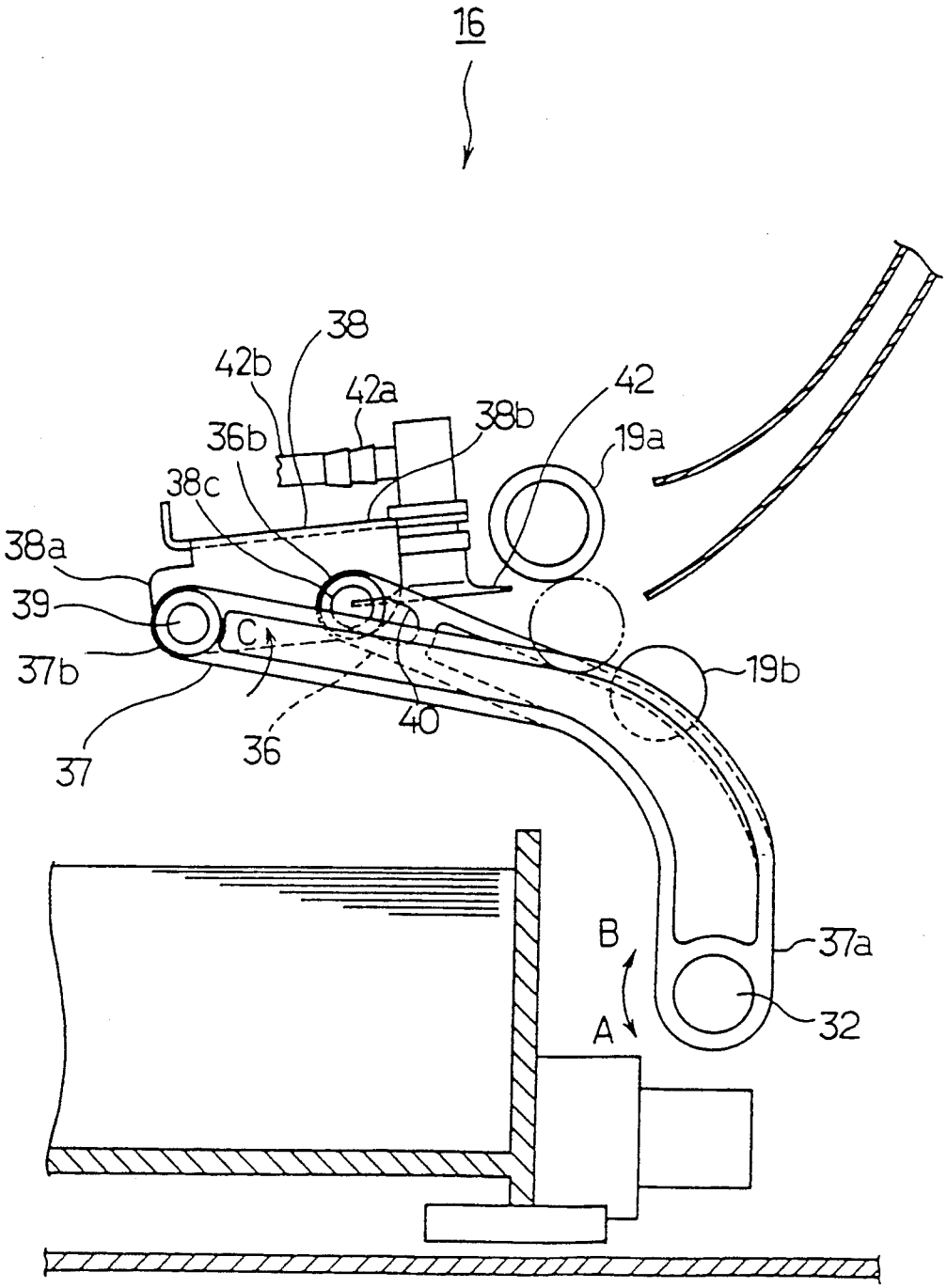
FIG. 2 is a side elevational view, partly cut away, showing a sheet supplying mechanism of a sheet supplying device.
Figure 3:
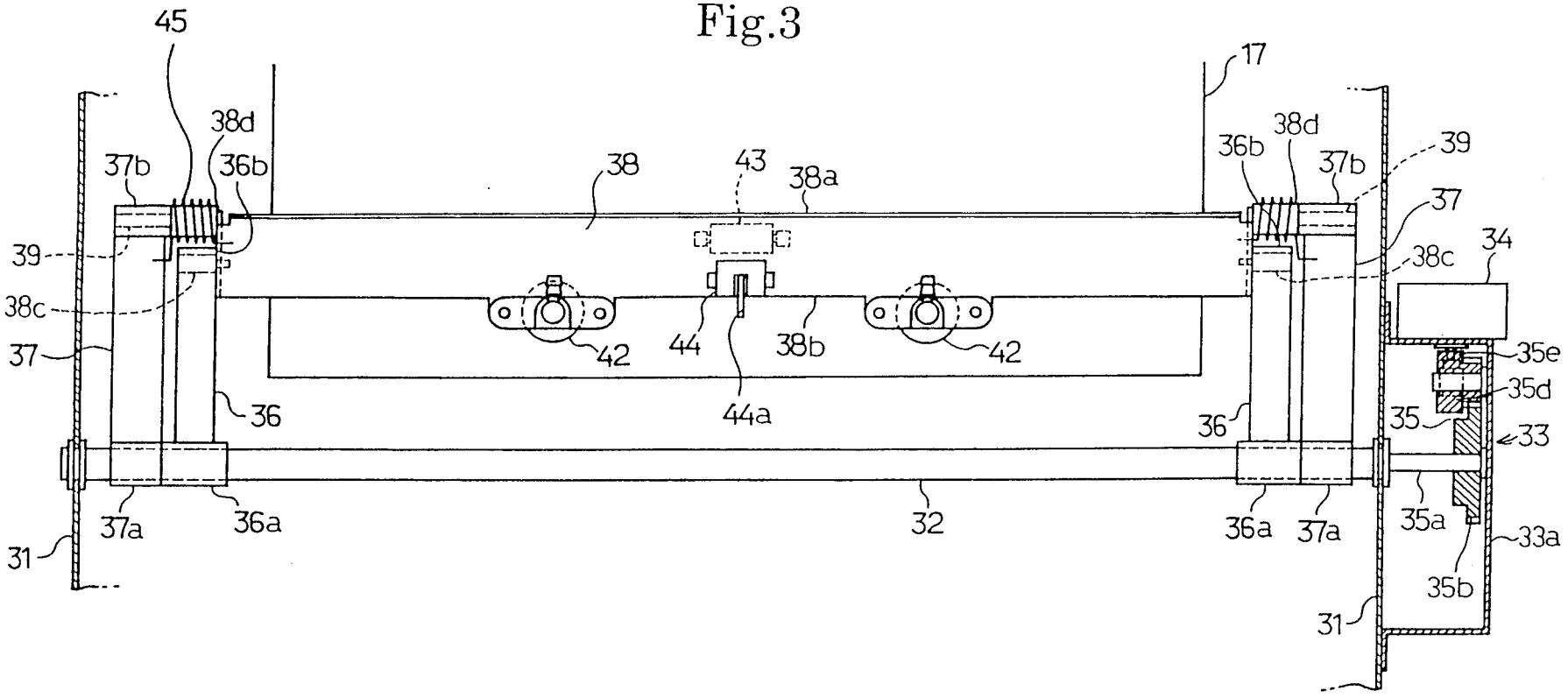
FIG. 3 is a plan view showing the sheet supplying device shown in FIG. 2.
Figure 4:
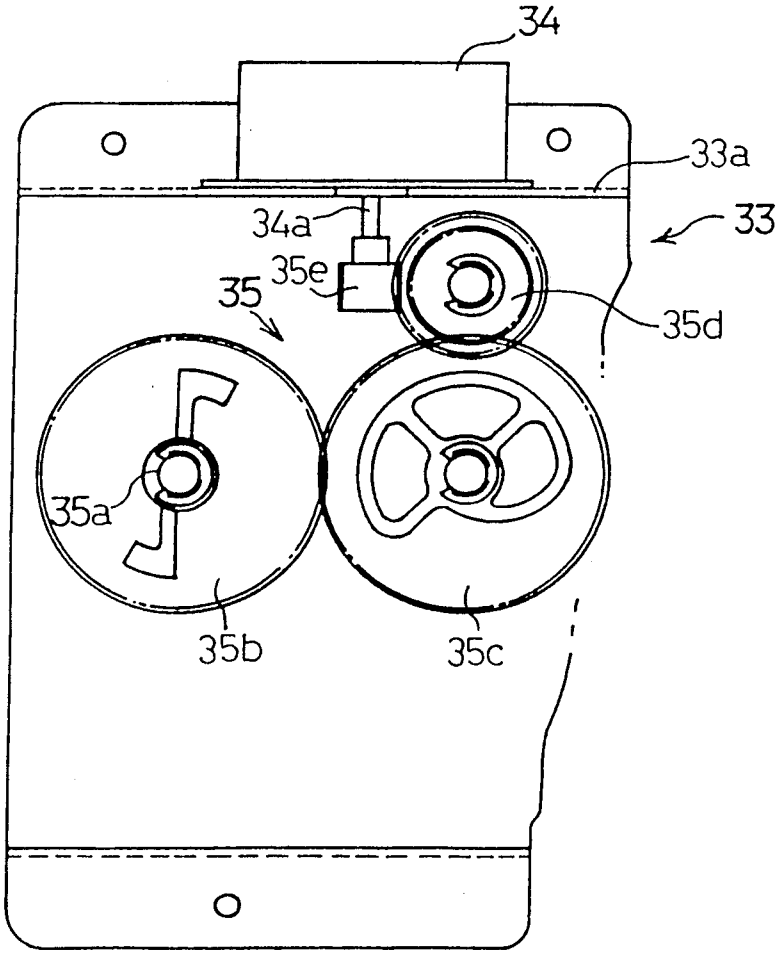
FIG. 4 is a front sectional view showing a drive unit.

Next, the sheet supplying device 16 for performing a sheet supplying operation utilizing suction means having a suction cup will be described in detail with reference to FIGS. 2 and 3. The sheet supplying operation is performed so that the developer sheets 18 stacked in the sheet cassette 17 are individually supplied and fed along a feeding direction. The sheet supplying device 16 includes a pair of frames 31, the sheet cassette 17 being disposed between this pair of frames 31. A horizontally oriented drive shaft 32 is installed between the frames 31 on a side of the sheet cassette 17 from which the developer sheets 18 are supplied. Drive shaft 32 is rotatable as shown by arrows A and B in FIG. 2. As described in FIG. 2, this drive shaft 32 is located at about half the total maximum height at which the developer sheets 18 can be stacked in the sheet cassette 17. Moreover, this drive shaft 32 is rotated by a drive unit 33 provided on the right side of the right frame 31, as shown in FIG. 3. As shown in FIG. 4, drive unit 33 includes a frame 33*a*, a motor 34 fixed to the frame 33*a* and a reduction gear mechanism 35 which comprises a reduction gear 35*b*, a reduction gear 35*c*, a worm gear 35*d* and a worm gear 35*e* to reduce the rotation speed of a motor shaft 34*a* of the motor 34. An output shaft 35*a* of this reduction gear mechanism 35 is connected with the drive shaft 32. Drive shaft 32 can be rotated in the directions indicated by the arrows A and B (as shown in FIG. 2) by the drive unit 33.

The sheet supplying device 16 includes a pair of first arms 36 disposed beyond the sides of the sheet cassette 17 and a pair of second arms 37 disposed between the first arms 36 and the frames 31 (as shown in FIG. 3). Base portions 36*a* of the first arms 36 are fixedly mounted to the drive shaft 32 for rotating together with the drive shaft 32. The base portions 36*a* and drive shaft 32 can be connected by for example, a key-type engagement or a D-type shaft engagement (shaft 32 has a D-shaped cross-section which engages a D-shaped hole in base portion 36*a*) to rotate the first arms 36 together with the drive shaft 32. First arms 36 are formed in the shape of the letter L and curve in the direction of the sheet cassette 17, so that head portions 36*b* thereof are always located above the sheets stacked in the sheet cassette 17. Further, base portions 37*a* of the second arms 37 are rotatably engaged on drive shaft 32 and are disposed outside of the base portions 36*a* of the first arm 36. Therefore, these second arms 37 can rotate about an axis defined by the drive shaft 32. These second arms 37 are shaped like the letter L and also curve in the direction of sheet cassette 17, the head portions 37*b* of the second arms 37 always being located above sheets in sheet cassette 17. The head portions 37*b* are located backward (upstream in the sheet feeding direction) of the head portions 36*b* of the first arms 36. An elevator arm or supporting means 38 is connected with the pair of head portions 36*b* of the first arms 36 and tho pair of head portions 37*b* of the second arms 37 in a manner described below. The elevator arm 38 has a width in the direction perpendicular to the feeding direction which is longer than the width of the sheet cassette 17 and a length in the direction parallel to the feeding direction so as to be supported by both arms 36 and 37. Both sides of the elevator arm 38 are supported by the first arms 36 and the second arms 37 by first and second convex portions (or pins) 38*c*, 38*d*, respectively. The elevator arm 38 has the first convex portions 38*c* which are engaged with the first arms 36 and the second convex portions 38*d* which are engaged with the second arms 37. A base side 38*a* of the elevator arm 38 (which is the rear side relative to the feeding direction) is rotatably connected with the head portions 37*b* of the second arms 37 through shafts 39 installed at both sides of the second convex portions 38*d*. Shafts 39 pass through apertures, or concave portions, of head portions 37*b*. A head side 38*b* of the elevator arm 38 (which is spaced from the rotation center defined by the shafts 39), is connected with the head portions 36*b* of the first arms 36 in a manner described below. Slots 40 along the first arms 36 are formed in the head portions 36*b* of the first arms 36. The first convex portions 38*c* fixed to both sides of the elevator arm 38 are slidably engaged in the slots 40. Thus, the first arms 36 and the elevator arm 38 are connected so that the elevator arm 38 may slide along the first arms 36.

A pair of suction cups 42 are further installed on the above-mentioned head side 38*b* of elevator arm 38 and are located at about the center of the width of elevator arm 38. Tubes 42*b*, shown in FIG. 2, are installed on valves 42*a* of suction cups 42. An opposite other end (not shown) of the tubes 42*b* are connected to a decompression device which is well known in the art. The developer sheet 18 can be attracted by applying and maintaining a negative pressure state between the surface of the suction cups 42 and the developer sheet 18.

Figure 5:
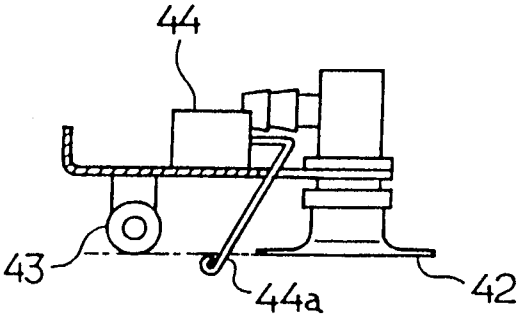
FIG. 5 is a sectional view showing a roller, an actuator and a suction cup mounted in the middle of an elevator arm.

Moreover, as shown in FIGS. 3 and 5, a roller 43 is provided under the above mentioned base side 38*a* at about the center of the elevator arm 38. A microswitch 44, used as a position detection sensor of the uppermost sheet 18, is further provided on the head side 38*b* at about the center of the elevator arm 38. The microswitch 44 has an actuator 44*a* to be contacted with the uppermost sheet 18 which projects downwardly between both suction cups 42. The microswitch 44 detects the upward movement of the actuator 44*a* when the actuator 44*a* is contacted with the uppermost sheet 18 and is moved upwardly with continued downward movement of the elevator arm 38. The lower surface of the roller 43 is positioned on the same level as the lower surface of the suction cups 42. The actuator 44*a* projects from the above mentioned level to the lower side in order to detect the uppermost sheet reliably.

A pair of twisted coil springs 45 are interposed as urging members between the head portions 37*b* of the second arms 37 and the base sides 38*a* of the elevator arm 38 and are wound around the second convex portions 38*d*. The twisted coil springs 45 supported by the second arms 37 and the base sides 38*a* of the elevator arm 38 are used so as to keep the first convex portions 38*c* of the elevator arm 38 in a position where they contact the backward edge (see FIG. 2) of the slots 40 of the first arms 36 before the roller 43 contacts the uppermost sheet 18. Coil springs 45 are used to urge the elevator arm 38 to rotate in the direction C (illustrated in FIG. 2) as the suction cups 42 are moved upwardly from the sheet cassette.

Operation of the sheet supplying device 16 thus constructed will be described below with reference to FIGS. 2, 3, and 6(*a*) through 6(*d*). It is assumed that the first arms 36 are initially disposed in a home position shown in FIG. 2.

The first arms 36 are rotated so that the first arms 36 move downwardly from the home position to the upper surface of the sheet 18 when the motor 34 of the drive unit 33 is driven, and the drive shaft 32 is rotated in the direction indicated by the arrow A in response to a sheet feed signal for supplying a sheet 18. Because the head portions 37*b* of the second arms 37 are connected with the head portions 36*b* of the first arms 36 by the elevator arm 38, the second arms 37 rotate based on the rotating movement of the first arms 36 so that the head portions 37*b* of the second arms 37 move downwardly with the elevator arm 38. In this case, the elevator arm 38 is urged by the twisted coil springs 45 in a direction so that the suction cups 42 are spaced from the sheets 18, and the second arms 37 and the elevator arm 38 are rotated with a constant positional relation being maintained between the second arms 37 and the elevator arm 38 with the rotation movement of the first arms 36. Then, the roller 43 located on the base side 38*a* of the elevator arm 38 contacts the sheet 18. This occurs earlier than suction cups 42 touch the sheet 18 (as shown in FIG. 6(*a*)). After roller 43 contacts sheet 18, the drive shaft 32 continues to rotate in the direction indicated by the arrow A and the first arm 36 continues to rotate downwardly. At this time, the second arm 37 cannot rotate because the roller 43, which has contacted the upper surface of the sheet 18, cannot be moved downwardly any further. Therefore, the elevator arm 38 starts to rotate in the direction indicated by the arrow D shown in FIG. 6(*a*) about the head portion 37*b* of the second arm 37 against the biasing force of the twisted coil springs 45. The first convex portions 38*c* move along the slots 40 as the elevator arm 38 rotates. The elevator arm 38 continues to rotate to the direction indicated by the arrow D, the point at which the roller 43 contacts with the sheet 18 defining a center of rotation. As a result of this movement, the suction cups 42 come into contact with the sheet at an optimal position where a surface of the suction cups 42 are parallel to the sheet surface (as shown in FIG. 6(*b*)).

This optimal position is achieved because the center of rotation of the elevator arm 38 always maintains a predetermined positional relation with the uppermost sheet 18 irrespective of the height of the stack of the developer sheets 18.

When the microswitch 44 detects contact with the uppermost sheet, the decompression device is actuated. A negative pressure is developed in the suction cups 42 to enable the suction cups 42 to attract the uppermost developer sheet 18. In this case, the suction cups 42 reliably attract the developer sheet 18 regardless of the height of the stack of the developer sheets 18 because the suction cups 42 come into contact with the uppermost sheet.

With the suction cups 42 attracting the uppermost developer sheet 18, the motor 34 of the driving unit 33 is reversed to turn the driving shaft 32 in the direction indicated by the arrow B. The elevator arm 38 rotates until the position indicated by FIG. 6(*c*), lifting the uppermost developer sheet 18 attracted by the suction cups 42 as convex portions 38*c* slide to the back edge of slots 40.

Figure 6A:
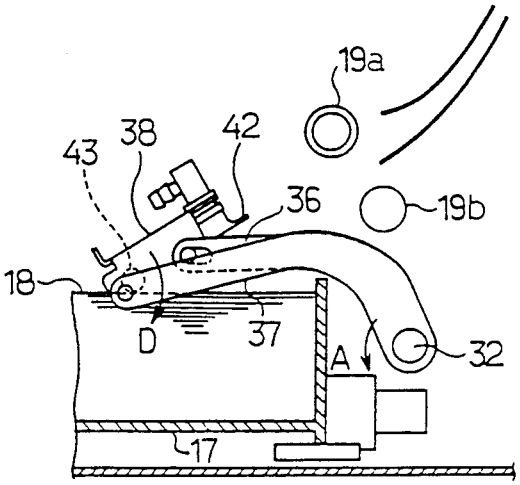
FIGS. 6(*a*)–6(*d*) are sectional side elevational views showing a series of sheet supplying operations of the sheet supplying device.
Figure 6B:
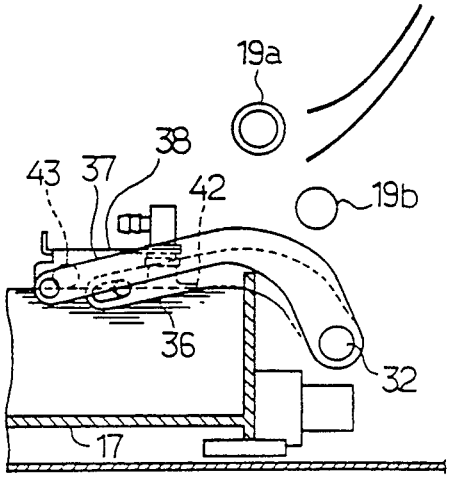
Figure 6C:
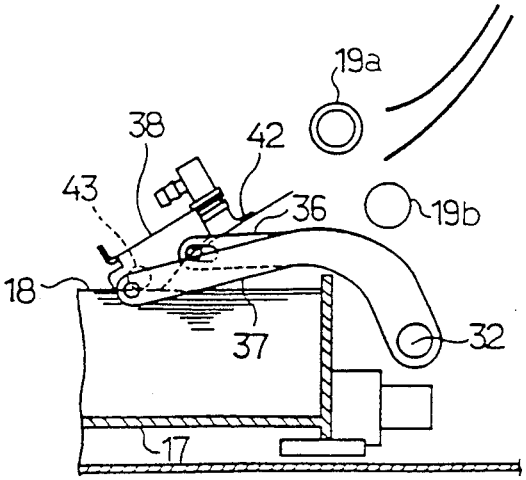
Figure 6D:
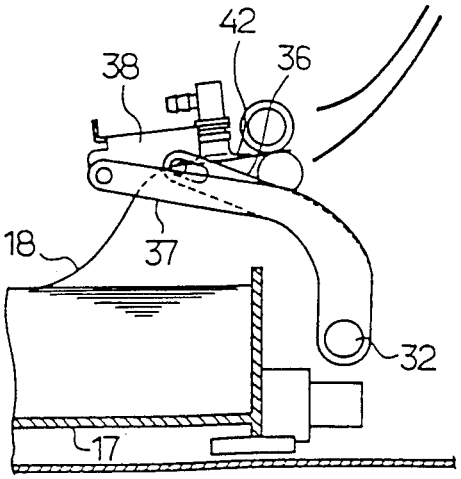

Shaft 32 continues to rotate until the position shown in FIG. 6*d* is achieved, maintaining the angular relation of the first arm 36, the second arm 37 and the elevator arm 38. The leading end of the developer sheet 18 is then nipped between the feed roller 19*a* and the pinch roller 19*b*, and the developer sheet 18 is fed after the suction is released by de-actuating the decompression device.

As another embodiment, the base portions 37*a* of the second arms 37 are not attached to the drive shaft 32, but the base portions 37*a* of the second arms 37 may be attached to different surfaces disposed near the drive shaft 32.

As described above, this invention is different from a conventional sheet supplying device by which the rotation of the drive motor must be converted into a straight line movement. The entire operation of this invention is simple because the developer sheet 18 is attracted only by a simple rotation operation. Further, the developer sheet 18 is reliably attracted.

As another embodiment, the exposing means is not constructed so that an original supported by the supporting stand glass is movable back and forth, and the light source is held at a predetermined position, but may be constructed so that the light source is movable back and forth, and an original supported by the supporting stand glass is held at a predetermined position.

As many apparently widely different embodiments of this invention may be made without departing from the spirit and scope thereof, it is to be understood that the invention is not limited to the specific embodiments thereof except as defined in the appended claims.

What is claimed is:

1. A sheet supplying device for supplying a sheet stacked in a sheet cassette to a sheet feed path and for feeding the sheet along a feeding direction, wherein the sheet is fed from the sheet cassette which is disposed upstream of the sheet feed path relative to the feeding direction, comprising:

rotating means for rotating clockwise and counterclockwise and being positioned downstream of the sheet cassette relative to the feeding direction;

suction means for attracting an uppermost sheet stacked in the sheet cassette with suction;

supporting means for supporting said suction means, and having a first part at a downstream side thereof relative to the feeding direction, and a second part spaced upstream of said first part relative to the feeding direction, and an edge located near said second part for being contacted with the uppermost sheet;

a first arm rotatable clockwise and counterclockwise by said rotating means, and having a base portion fixedly mounted to said rotating means, and a head portion slidably engaged with said first part of the supporting means so that said first part of the supporting means can slide along the first arm;

a second arm having a head portion rotatably attached to said second part of the supporting means, and a base portion pivotally mounted to a support and having a length so that the supporting means and the first arm can be moved by said rotating means to allow the suction means to attract the uppermost sheet; and rotating controlling means for controlling said rotating means so that said rotating means rotates said first arm counterclockwise so that said edge of the supporting means contacts the uppermost sheet and further continues to rotate said first arm counterclockwise so that said first part of the supporting means slides along the first arm to cause the supporting means to rotate clockwise around a point at which the supporting means is pivotally attached to the second arm to cause said suction means to contact the uppermost sheet, said rotating means stopping the counterclockwise rotation upon contacting of the suction means with the uppermost sheet, said rotating means then rotating said first arm clockwise to feed the attracted uppermost sheet to the sheet feed path.

2. The sheet supplying device as defined in claim 1, wherein said supporting means has a width in a direction perpendicular to the feeding direction which is longer than a width of the sheet cassette and has two sides, parallel to the feeding direction, said supplying device further comprising a pair of said first arms and a pair of said second arms, one of each first and second arms being located adjacent to a respective side of said supporting means, which sides are engaged with head portions of said pair of first arms and head portions of said pair of second arms.

3. The sheet supplying device as defined in claim 2, wherein said supporting means has a pair of convex portions, one convex portion at each of said two sides of the supporting means, and said pair of first arms have slots at their respective head portions, said convex portions being inserted in said slots to move along said slots.

4. The sheet supplying device as defined in claim 3, wherein said supporting means has a second pair of convex portions, one of the second convex portions at each of said two sides of the supporting means and said pair of second arms have concave portions which pivotally engage the second convex portions at their head portions.

5. The sheet supplying device as defined in claim 2, wherein said supporting means comprises detecting means for detecting contact of said suction means with the uppermost sheet.

6. The sheet supplying device as defined in claim 2, wherein said supporting means includes a roller which is movable into contact with the uppermost sheet and is disposed at said edge adjacent to said second part.

7. The sheet supplying device as defined in claim 1, wherein said rotating means comprises a pivotal shaft which is rotatable clockwise and counterclockwise and fixedly mounted to the base portions of the first arms, and driving means for rotating the pivotal shaft clockwise and counterclockwise.

8. The sheet supplying device as defined in claim 1, wherein said suction means comprises a suction cup to be contacted with the uppermost sheet and decompression means connected to the suction cup for maintaining a negative pressure state in said suction cup so that the suction cup attracts the uppermost sheet.

9. The sheet supplying device as defined in claim 8, further comprising detecting means for detecting the uppermost sheet and for generating a detecting signal based on the detection, wherein said decompression means starts to maintain the negative pressure state when said decompression means receives the detecting signal.

10. The sheet supplying device as defined in claim 1, wherein said rotating means includes a pivotal shaft rotatable clockwise and counterclockwise, and said support is the pivotal shaft.

11. A sheet supplying device for supplying a sheet stacked in a sheet cassette to a sheet feed path and for feeding the sheet along a feeding direction, wherein the sheet is fed from the sheet cassette disposed upstream of the sheet feed path relative to the feeding direction, comprising:

rotating means for rotating clockwise and counterclockwise and being positioned downstream of the cassette relative to the feeding direction;

suction means for attracting an uppermost sheet stacked in the sheet cassette with suction;

supporting means for supporting said suction means, and having a first part at a downstream side thereof relative to the feeding direction and a second part spaced upstream of said first part relative to the feeding direction, and an edge located near said second part for being contacted with the uppermost sheet;

a first arm rotatable clockwise and counterclockwise by said rotating means, and having a base portion fixedly mounted to said rotating means, and a head portion slidably engaged with said first part of the supporting means so that said first part of the supporting means can slide along the first arm;

a second arm having a head portion rotatably attached to said second part of the supporting means, and a base portion pivotally mounted to a support and having a length so that the supporting means and the first arm can be moved downwardly by said rotating means to allow the suction means to attract the uppermost sheet;

rotating controlling means for controlling said rotating means so that said rotating means rotates said first arm counterclockwise so that said edge of the supporting means contacts the uppermost sheet and further continues to rotate said first arm counterclockwise so that said first part of the supporting means slides along the first arm to cause the supporting means to rotate clockwise around a point at which the supporting means is pivotally attached to the second arm to cause said suction means to contact the uppermost sheet, said rotating means stopping the counterclockwise rotation upon contacting of the suction means with the uppermost sheet, said rotating means then rotating said first arm clockwise to feed the attracted uppermost sheet to the sheet feed path; and biasing means, positioned between the head portion of the second arm and said second part of said supporting means for biasing the supporting means and the second arm away from each other.

12. The sheet supplying device as defined in claim 11, wherein said rotating means includes a pivotal shaft rotatable clockwise and counterclockwise, and said support is the pivotal shaft.

13. The sheet supplying device as defined in claim 11, wherein said supporting means has a width in a direction perpendicular to the feeding direction which is longer than a width of the sheet cassette and has two sides, parallel to the feeding direction, said supplying device further comprising a pair of said first arms and a pair of said second arms, one of each first and second arms being located adjacent to a respective side of said supporting means, which sides are engaged with head portions of said pair of first arms and head portions of said pair of second arms.

14. The sheet supplying device as defined in claim 13, wherein said supporting means includes a pair of convex portions, one convex portion at each of said two sides of the supporting means, and said pair of first arms have slots at their respective head portions, said convex portions being inserted in said slots to move along said slots.

15. The sheet supplying device as defined in claim 14, wherein said supporting means includes a second pair of convex portions, one of the second convex portions at each of said two sides of the supporting means and said pair of second arms have concave portions which pivotally engage the second convex portions at their head portions.

16. The sheet supplying device as defined in claim 13, wherein said supporting means comprises detecting means for detecting contact of said suction means with the uppermost sheet.

17. The sheet supplying device as defined in claim 13, wherein said supporting means includes a roller which is movable into contact with the uppermost sheet and is disposed at said edge adjacent said second part.

18. The sheet supplying device as defined in claim 11, wherein said rotating means comprises a pivotal shaft being rotatable clockwise and counterclockwise and fixedly mounted to the base portions of the first arms, and driving means for rotating the pivotal shaft clockwise and counterclockwise.

19. The sheet supplying device as defined in claim 11, wherein said suction means comprises a suction cup to be contacted with the uppermost sheet and decompression means connected to the suction cup for maintaining a negative pressure state in said suction cup so that the suction cup attracts the uppermost sheet.

20. The sheet supplying device as defined in claim 19, further comprising detecting means for detecting the uppermost sheet and for generating a detecting signal based on the detection, wherein said decompression means starts to maintain the negative pressure state when said decompression means receives the detecting signal.

21. A sheet supplying device for supplying a sheet stacked in a sheet cassette to a sheet feed path and for feeding the sheet along a feeding direction, wherein the sheet is fed from the sheet cassette disposed upstream of the sheet feed path relative to the feeding direction, comprising:

rotating means for rotating clockwise and counterclockwise and being positioned downstream of the cassette relative to the feeding direction;

suction means for attracting an uppermost sheet stacked in the sheet cassette with suction;

supporting means for supporting said suction means, and having a first part at a downstream side thereof relative to the feeding direction and a second part spaced upstream of said first part relative to the feeding direction, and an edge located near said second part for being contacted with the uppermost sheet;

a first arm rotatable clockwise and counterclockwise by said rotating means, and having a base portion fixedly mounted to said rotating means, and a head portion having a slot slidably engaged with said first part of the supporting means, said slot having an upstream end and a downstream end relative to the feeding direction, said first part of the supporting means being slidable along the first arm slot;

a second arm having a head portion rotatably attached to said second part of the supporting means, and a base portion pivotally mounted to a support and having a length so that the supporting means and the first arm can be moved downwardly by said rotating means to allow the suction means to attract the uppermost sheet;

rotating controlling means for controlling said rotating means so that said rotating means rotates said first arm counterclockwise so that said edge of the supporting means contacts the uppermost sheet and further continues to rotate said first arm counterclockwise so that the supporting means slides along the first arm slot from the upstream slot end to the downstream slot end to cause the supporting means to rotate clockwise around a point at which the supporting means is pivotally attached to the second arm to cause said suction means to contact the uppermost sheet, said rotating means stopping the counterclockwise rotation upon contacting of the suction means with the uppermost sheet, said rotating means then rotating said first arm clockwise to feed the attracted uppermost sheet to the sheet feed path; and biasing means for biasing the first part of the supporting means toward the upstream end of said slot.

* * * * *